US011445784B2

(12) United States Patent
Brown et al.

(10) Patent No.: US 11,445,784 B2
(45) Date of Patent: Sep. 20, 2022

(54) ADJUSTABLE RESPONSE ELASTIC KINETIC ENERGY CONVERTER AND STORAGE FIELD SYSTEM FOR A FOOTWEAR APPLIANCE

(71) Applicant: Worcester Polytechnic Institute, Worcester, MA (US)

(72) Inventors: Christopher A. Brown, Waterbury Center, VT (US); James J. Muller, Worcester, MA (US); Winton Parker, Waitsfield, VT (US); Allysa Grant, Worcester, MA (US); Tristin J. Carlton, Coventry, RI (US); Nicholas Workman, Worcester, MA (US); Michael Doyle, Worcester, MA (US); Jessica Shelsky, Worcester, MA (US); Jessica K. Y. Cheu, Worcester, MA (US); Lorenzo Dube, Worcester, MA (US); Pedro D. Oporto, Worcester, MA (US); Olivia G. Steen, Worcester, MA (US); Andrew R. Vickery, Worcester, MA (US)

(73) Assignee: Worcester Polytechnic Institute, Worcester, MA (US)

( * ) Notice: Subject to any disclaimer, the term of this patent is extended or adjusted under 35 U.S.C. 154(b) by 186 days.

(21) Appl. No.: 16/592,883

(22) Filed: Oct. 4, 2019

(65) Prior Publication Data

US 2020/0100562 A1 Apr. 2, 2020

Related U.S. Application Data

(63) Continuation-in-part of application No. 15/675,989, filed on Aug. 14, 2017, now Pat. No. 10,888,138, (Continued)

(51) Int. Cl.

| | |
|---|---|
| ***A43B 13/18*** | (2006.01) |
| ***A43B 13/12*** | (2006.01) |
| ***A43B 13/04*** | (2006.01) |

(52) U.S. Cl.

CPC ..... *A43B 13/127* (2013.01); *A43B 13/04* (2013.01); *A43B 13/185* (2013.01)

(58) Field of Classification Search

CPC ..... A43B 13/127; A43B 13/04; A43B 13/185

(Continued)

(56) References Cited

U.S. PATENT DOCUMENTS

| | | | |
|---|---|---|---|
| 3,195,685 | A | 7/1965 | Blackstone |
| 3,251,144 | A | 5/1966 | Weitzner |

(Continued)

FOREIGN PATENT DOCUMENTS

| | | | |
|---|---|---|---|
| GB | 2 264 627 | A | 9/1993 |
| GB | 2492864 | A | 1/2013 |

(Continued)

OTHER PUBLICATIONS

International Search Report, PCT/US2019/054617, dated Dec. 19, 2019, pp. 2.

*Primary Examiner* — Marie D Bays

(74) *Attorney, Agent, or Firm* — Armis IP Law, LLC

(57) ABSTRACT

A force absorbing device for a footwear appliance includes a shoe upper and a shoe sole having a planar sole surface, such that forces between the shoe upper and planar sole surface in ground contact are absorbed by force mitigation structures disposed in the shoe sole. A footwear article includes a split-sole system that redefines a shoe sole as coplanar surfaces having a force mitigating interface for receiving sudden forces and effectively mitigating these forces by storing kinetic energy and releasing it over time. An elastic field in the force mitigation structure is defined by (Continued)

a resilient material adapted to deform in response to the received force. Frictional engagement between the upper and lower sole may also be augmented by surface characteristics such as dimples, voids and lubricants, in addition to interference engagement with an elastic field.

11 Claims, 6 Drawing Sheets

Related U.S. Application Data which is a continuation-in-part of application No. 13/860,877, filed on Apr. 11, 2013, now Pat. No. 9,730,486.

(60) Provisional application No. 62/741,823, filed on Oct. 5, 2018, provisional application No. 61/623,430, filed on Apr. 12, 2012.

(58) Field of Classification Search
USPC ..... 36/25 R, 30 R, 31
See application file for complete search history.

(56) References Cited

U.S. PATENT DOCUMENTS 3,668,792 A 6/1972 York
3,707,047 A 12/1972 Zygmund
3,834,046 A * 9/1974 Fowler ..... A43B 13/181 36/28
4,187,620 A * 2/1980 Seiner ..... A43B 13/182 36/28
4,546,556 A 10/1985 Stubblefield
4,651,446 A 3/1987 Yukawa et al.
4,670,997 A 6/1987 Beekman
5,224,810 A * 7/1993 Pitkin ..... A43B 7/24 36/25 R
5,255,453 A 10/1993 Weiss
5,456,027 A 10/1995 Tecchio et al.
5,502,901 A 4/1996 Brown
5,619,809 A * 4/1997 Sessa ..... A43B 7/06 36/28
5,661,927 A 9/1997 Polowinczak et al.
5,701,685 A 12/1997 Pezza
5,867,923 A * 2/1999 Lehneis ..... A43B 13/12 36/25 R
5,881,478 A * 3/1999 McMahon ..... A43B 13/181 36/144
5,937,544 A 8/1999 Russell
6,138,385 A * 10/2000 Jungkind ..... A43B 1/0018 36/102
6,237,255 B1 * 5/2001 Renaudin ..... A43B 3/26 36/102
6,327,795 B1 12/2001 Russell
6,378,169 B1 4/2002 Batten et al.
6,665,958 B2 12/2003 Goodwin
6,684,531 B2 2/2004 Rennex
7,013,581 B2 3/2006 Greene et al.
7,254,905 B2 8/2007 Dennison
7,334,349 B2 2/2008 Sokolowski et al.
7,464,490 B2 12/2008 Lebo
7,487,606 B2 2/2009 Koo et al.
7,946,059 B2 5/2011 Borel
8,261,469 B2 9/2012 Aveni et al.
8,365,444 B2 * 2/2013 Youngs ..... A43B 13/141 36/102
8,387,279 B2 3/2013 Pauk et al.
8,397,402 B2 3/2013 Lucas et al.
8,776,397 B2 7/2014 Borel et al.
9,339,074 B2 5/2016 Ellis
9,693,605 B2 7/2017 Beers
9,730,486 B2 8/2017 Brown et al.
10,226,097 B2 * 3/2019 Farris ..... A43B 13/04
10,244,821 B2 4/2019 Elder et al.
10,888,138 B2 * 1/2021 Brown ..... A43B 13/203
2007/0011919 A1 1/2007 Case, Jr. et al.
2007/0240331 A1 10/2007 Borel
2009/0113758 A1 5/2009 Nishiwaki et al.
2009/0235556 A1 9/2009 Reid
2009/0278707 A1 11/2009 Biggins et al.
2009/0284368 A1 11/2009 Case, Jr. et al.
2010/0077638 A1 4/2010 Simms
2010/0122471 A1 5/2010 Edington et al.
2012/0042540 A1 2/2012 Miner
2012/0079747 A1 4/2012 Seo
2012/0210606 A1 * 8/2012 Gheorghian ..... A43B 5/06 36/103
2015/0040435 A1 2/2015 Barnes et al.
2017/0006962 A1 1/2017 Tanabe et al.
2017/0049183 A1 * 2/2017 Foxen ..... A43B 13/185
2017/0238652 A1 * 8/2017 Langvin ..... A43B 13/14
2017/0325543 A1 11/2017 Iuchi et al.
2018/0042339 A1 2/2018 Barnes et al.
2018/0140043 A1 5/2018 Farris et al.
2018/0220736 A1 * 8/2018 Martin ..... A43B 7/32
2018/0338568 A1 * 11/2018 Chambers ..... A43B 3/0057
2020/0100559 A1 * 4/2020 Brown ..... A43B 7/1445
2020/0100562 A1 * 4/2020 Brown ..... A43B 13/14

FOREIGN PATENT DOCUMENTS

RU 2558343 C2 7/2015
RU 2624190 C2 6/2017
WO WO 2007/044451 A1 4/2007
WO 2011067768 A1 6/2011
WO 2012045512 A1 4/2012

* cited by examiner

ADJUSTABLE RESPONSE ELASTIC KINETIC ENERGY CONVERTER AND STORAGE FIELD SYSTEM FOR A FOOTWEAR APPLIANCE

RELATED APPLICATIONS

This patent application claims the benefit under 35 U.S.C. § 119(e) of U.S. Provisional Patent App. No. 62/741,823 filed Oct. 5, 2018, entitled "ADJUSTABLE RESPONSE, ELASTIC OR ELECTROMAGNETIC KINETIC ENERGY CONVERTER AND STORAGE FIELD SYSTEM," and is a Continuation-in-Part (CIP) of U.S. patent application Ser. No. 15/675,989, filed Aug. 14, 2017, entitled "SELF-RECOVERING IMPACT ABSORBING FOOTWEAR," which is a Continuation-in-Part (CIP) of U.S. patent application Ser. No. 13/860,877, now U.S. Pat. No. 9,730,486, filed Apr. 11, 2013, entitled "SELF-RECOVERING IMPACT ABSORBING FOOTWEAR," which claims the benefit under 35 U.S.C. § 119(e) of U.S. Provisional Patent App. No. 61/623,430, filed Apr. 12, 2012, entitled "SELF-RECOVERING IMPACT ABSORBING FOOTWEAR," all incorporated herein by reference in entirety.

BACKGROUND

Athletic injuries, such as from overstressed musculoskeletal structures, can be traumatic and career ending. ACL (anterior cruciate ligament) injuries are particularly notorious and prone to recurrence. These and other injuries often result from some form of loads (e.g., forces and torques) transferred through the footwear of the athlete to the foot and on to an anatomical member, such as a bone, ligament, cartilage, tendon or other tissue structure. Mitigation of the transfer of these loads can substantially eliminate or alleviate injury risk to the foot, ankle, lower leg and knee. Because an athlete's footwear defines the ground interface, the footwear defines the focal point of potentially injurious load transfers. Shoe soles for athletic usage often employ high friction materials such as rubber and flexible polymers to "grip" the playing surface, and also employ a texture, ribs or protrusions on the bottom surface to avoid slipping. These conventional materials and structures increase the load transfer from the athletes to the playing surface and when unmitigated, raise these loads an injury threshold.

Cushioning, padding and air bladders purport to distribute forces in conventional shoes, however these devices exhibit behavior similar to conventional springs. Most conventional mechanical springs have a single, consistent positive stiffness (force/displacement) throughout their deformation, e.g., stretching or compressing, until they reach the limit of their displacement, at which point the stiffness becomes large and substantially like an inelastic material. Conventional constant-force springs are characterized by large displacements, and low-forces, such as found for vacuum cleaner cords and tape measures. Constant-force and other non-linear springs are generally characterized by low loads minimal variance or "cushioning" once the constant force is reached and displacement continues equivalent to the constant force.

SUMMARY

A force limiting, energy absorbing device for a footwear appliance includes a shoe upper and a shoe sole having a planar sole surface, such that forces between the shoe upper and planar sole surface in ground contact are limited by absorption, storage and controlled release of kinetic energy in an elastic or resilient field. Some of the energy will naturally be lost to friction in the movement between the soles and in the devices, which can partly control transmission as well. A footwear article such as a shoe or boot includes a split-sole system that redefines a shoe sole as coplanar surfaces having a force mitigating interface for receiving sudden forces and effectively mitigating these forces by storing kinetic energy and releasing it over time to return the shoe to its unloaded configuration. An elastic field in the force mitigation structure is defined by a resilient material adapted to deform in response to the received force. Frictional engagement between the upper and lower sole may also be augmented by surface characteristics such as dimples, voids and lubricants, in addition to interference engagement with an elastic field or conventional elastic members.

Athletic injuries can be caused by sudden or impactful forces from running, twisting, turning, landing or falling, for example. Forces are generally transferred from a playing or ground surface to a skeletal or anatomical structure (bones, tendons, ligaments) that must travel through a footwear appliance or shoe. Often, injuries result from lateral/medial or forward/backward forces, or some combination of them possibly with torques on the bottom of the sole surface that transfer to the foot of the wearer with little absorption or mitigation from a conventional shoe. Configurations herein dispose a split nominally planar, horizontal structure in the shoe sole so that the energies associated with lateral, medial forward, and backward forces and torques on a lower or ground contact surface are absorbed to limit these loads, rather than being passed to an upper or wearer through an interface layer. This results in an nominally coplanar system where loads in the plane defined by the shoe sole are mitigated by a system that stores and dissipates mechanical energy in mechanical, pneumatic, hydraulic, electrical, or magnetic elements of continuous, or discrete systems to control a load transfer through the split sole construction.

Additional usages address orthopedic needs of overstressed skeletal structures in an aging population. A societal need addressed is to reduce the likelihood of traumatic injuries to knees, ankles, and Achilles tendons, and to reduce repetitive loading injuries, as well as reducing foot discomfort and fatigue, foot irritation for diabetics, facilitating rehabilitation, and reducing the likelihood of ailments such as plantar fasciitis. It should be further noted that the force mitigation techniques herein are applicable to all dimensional components, e.g. lateral, medial, fore, aft, and vertical, regardless of the dimension in which force mitigation is illustrated.

Configurations herein are based, in part, on the observation that footwear often includes minimal load absorption material or structure, and that which is present, conforms to conventional spring responses. Unfortunately, conventional approaches suffer from the shortcoming that the conventional spring response, having a substantially linear force/displacement curve, rapidly approaches a maximum displacement such that high impact forces are often transmitted to the wearer with little mitigation. In other words, conventional active footwear, employing layers of rubber or foam, often used in conventional shoe construction, is insufficient to mitigate transfer of potentially harmful loads. A maximum compression threshold is rapidly attained, and the shoe sole acts as a substantially solid, inelastic material for transferring the load, with little or no capacity for mitigation.

Configurations herein employ an elastic field defined by a deformable material that absorbs force, and slowly releases stored forces over time to avoid a sudden or peak impact. An elastic field may employ a deformable member that deforms or "bends" along a longitudinal direction, or may employ a constricting channel and compressible material spring system (CSS) to draw, pull or push a compressible material, such as a polymer foam, into a channel that narrows with a funnel-like transition so that there is a deformation zone controlled by the channel geometry. The configuration can be such that a portion of the elastic material is deformed with movement between the layers and remains with approximately the same deformation as the next portion of the elastic is deformed by a similar amount. Or a cam system can be used to deform a spring with motion between the layers so that a non-linear load displacement behavior is achieved.

The disclosed system is adapted to moderate forces between or through the split-sole shoe construction, and may be modified or tuned for the timeliness (speed) and magnitude of compression and release of stored energy. Accordingly, configurations herein substantially overcome the above shortcomings by disclosing a force absorption and mitigation system including an elastic field or spring structures packaged for encapsulation in a shoe sole. The elastic field, spring system possibly in combination with friction, exhibits a flat or some other nonlinear response, rather than an initial displacement-proportional response followed by increased stiffness, so that abrupt or impact loads are met with a constant or controlled force response with of displacement for mitigating loads that tend to be associated with injury.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Configurations below demonstrate an approach to construct devices, structures and mechanisms, that control load transmission through the shoe to the foot by displacement of spring structures or systems thereof. Configurations herein employ combinations of springs to form spring systems with the desired response characteristics. As discussed in copending application <Insert WPI18-19 App. #>, filed concurrently, entitled "FOOTWEAR FORCE MITIGATION ASSEMBLY," force mitigation structures and other structures are employed in sole systems that hold and encapsulate the slidable sole components together.

The description below presents an example of a footwear appliance, or shoe, for implementing a split sole footwear configuration using a constant force, substantially constant force, or nonlinear spring structure for mitigating harmful transmission of lateral and torsional (twisting) forces transmitted from shoe soles, while transmitting loads required for ordinary use. The assembly, including the constant and nonlinear force spring systems, implements an elastic field approach where a counterforce is based on an area of the engaged elastic field, rather than a length of an elongated or contracted spring. The disclosed elastic field constant force spring for exerting a linear force response is also applicable in alternate contexts without departing from the claimed approach.

Figure 1:
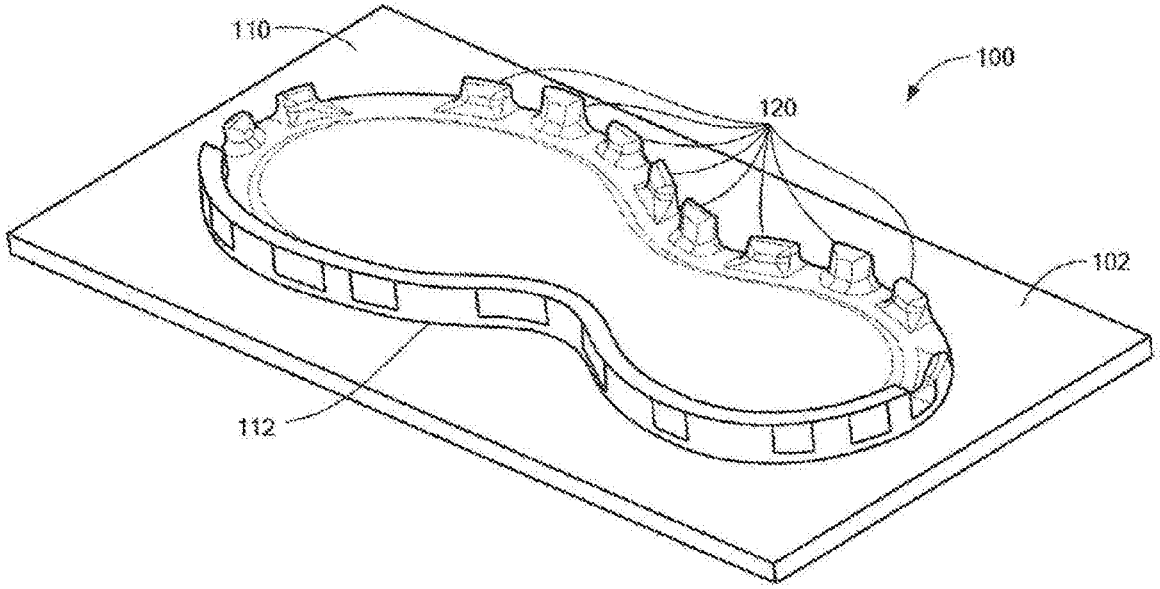
FIG. 1 is a perspective view of a perimeter-based shoe sole force mitigation approach.

FIG. 1 is a perspective view of a perimeter-based shoe sole force mitigation approach. In FIG. 1, a perspective view of a perimeter beam structure is shown in the form of resilient beams in a circumferential arrangement around a shoe sole surface. Referring to FIG. 1, a perimeter beam structure 100 includes a lower plane surface 110 having a plurality of beams 120 disposed around a perimeter 112 in the shape of a footwear appliance. Alternatively, varying lengths, cross-sections, curvatures, and material, including composites, of beams may be employed, depending on the tier thresholds of and properties of desired responses. The beams 120 extend orthogonally from the lower plane 110 and are adapted to slideably engage an upper plane discussed further below, and may be formed from a homogeneous molding 102 or sheet of resilient material from which a footwear shape may be cut.

Figure 2:
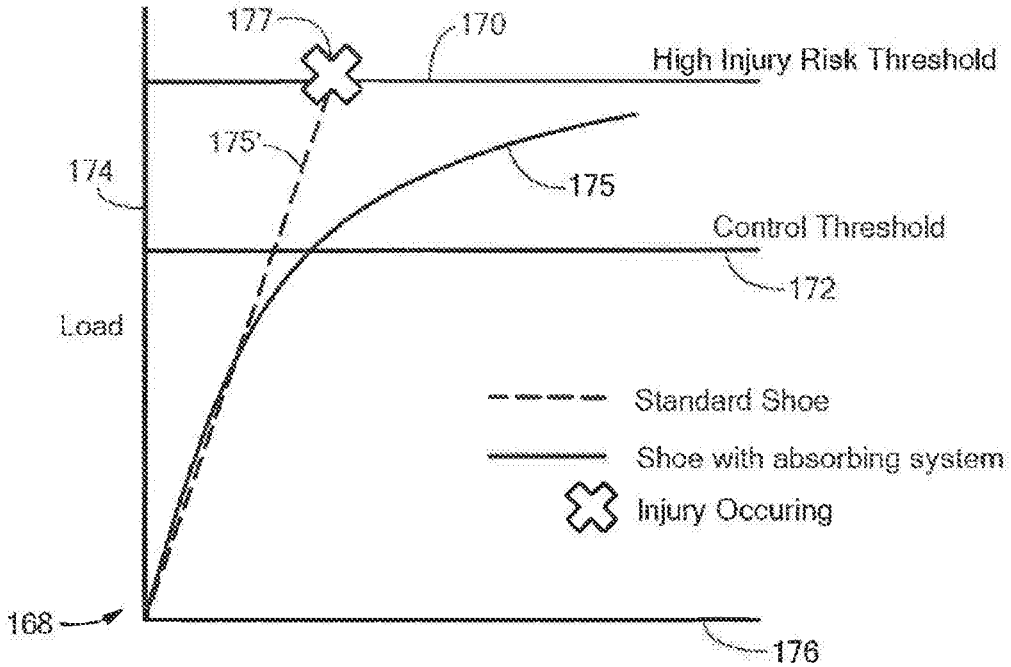
FIG. 2 is a force/performance graph of injurious forces mitigated by approaches herein.

FIG. 2 is a load-displacement, performance graph of potentially injurious energies absorbed to mitigate forces by approaches herein, and shows control and injury thresholds implemented in the configurations herein. Referring to FIGS. 1 and 2, a force graph 168 shows a relation between loads on the vertical axis 174, and corresponding displacement on the horizontal axis 176. The injury threshold 170 is defined by an excessive force of the shoe sole against the lower plane 110 (ground or playing surface), in which an excessive load, or combination of loads, transmits an undesirable level of loads to a wearer interface. Although these thresholds are conceptual, and difficult to quantify, it should be apparent that high energy and sports can impose loads between the footwear and playing surface as the wearer runs, changes direction, jumps, twists, etc. Ordinary levels of load maintains a firm transmission through the sole to the playing surface. At some threshold, these forces become sufficient such that, if not mitigated, can cause injury by transferring loads to anatomical structures such as an foot, ankle or leg bone, muscle, ligament, meniscus, or tendon. These are the loads that the disclosed load mitigation structure purports to address.

A control threshold 172 defines the load at which mitigation for potentially traumatic injuries begin to occur. Continued energy transmission causes progressively greater displacements below traumatic injury thresholds to avoid traumatic injuries by mitigating the force short of the traumatic injury threshold 170. Mitigation is such that the lateral-medial, forward-aft and rotational loads less than the control threshold 172 are permitted and nominally horizontal loads and rotational torques about a nominally vertical axis greater than the control threshold 172 are absorbed by the load mitigation structures, as shown by line 175 prior to loads attaining the injury threshold 170, shown by line 175,' until crossing the injury threshold at 177.

A shoe as defined herein includes any kind of footwear that is disposed between the foot of a wearer and the surface upon which it is deployed. Deployment, although athletic examples are depicted herein, may be any ambulatory activity such as walking, running, hiking, climbing or any usage that places the wearer's foot and ankle in a load bearing context with a floor, ground or playing surface. As will be apparent by the examples herein, the foot and ankle define a focal point of forces upon the skeletal frame of the wearer during any ambulatory activities, and are therefore a target of force mitigation as disclosed herein. In particular, configurations herein are beneficial to high impact athletics because these activities generate forces that seek an extreme threshold of human capacity. Substantial media attention has been directed to sports related injuries, particularly at the college and professional levels, and the resulting monetary aspects, both for rehabilitation and tortious omissions, has garnered the attention of sports management entities. The same and similar structures can be adjusted to mitigate lower loads that can lead to repetitive loading injuries.

Figure 3A:
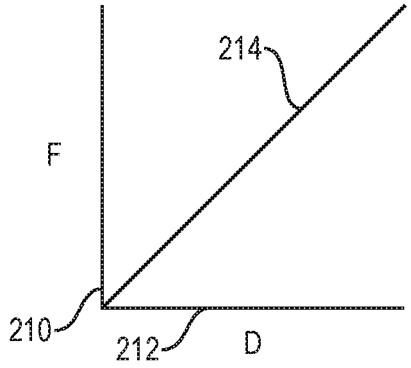
FIG. 3A (PRIOR ART)
FIGS. 3A-3B show a force mitigation curve implemented by the elastic field as in FIG. 1.
Figure 3B:
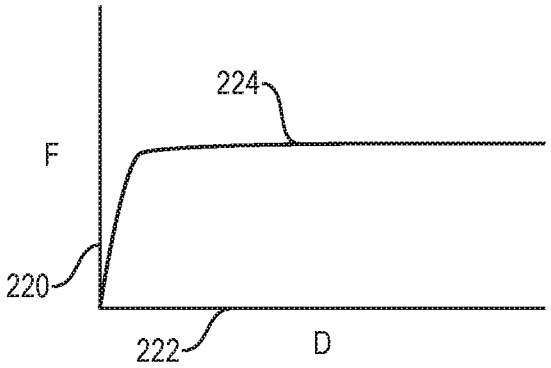

FIGS. 3A and 3B show a force mitigation curve implemented by the elastic field as in FIG. 2. FIG. 3A is a graph of prior art force displacement performance. In a conventional spring approach, a force 210 of an extended spring increases with the displacement 212 of the spring (line 214). An increasing level of force is required to continue displacement of an object connected to the spring, and a complementary return force is encountered upon release.

FIG. 3B is a graph of a constant or nonlinear load spring response as defined herein. An elastic field, in contrast to the spring of FIG. 3A, defines a constant or nonlinear load spring such that the force 220 required for displacement 222 remains substantially constant over the displacement distance, graphed as line 224 (following an initial compression period).

The disclosed split-sole (layered) shoe system can be envisioned in two components, one to interface with the external environment and another to hold the foot. In between these two components are systems to control load transmission.

There are two independent systems.

One system is between two mutually slidable layers in a shoe sole for controlling nominally horizontal loads, including torques about nominally vertical axes. The slidable layers, which are under the foot, should transmit vertical loads across low friction interfaces.

Another system controls nominally vertical load transmission between the sole of the shoe and a footbed. This vertical system is a kind of suspension system. This vertical spring system, supporting a footbed, could be in the sides of heel, positioned anteriorly, medially and laterally, or combinations of these.

Positioned medially and laterally these nonlinear springs systems could serve to tilt the footbed into turns, and level out uneven terrain, by keeping the vertical loads more similar laterally and medially than vertical absorption systems in current shoes. Conventional approaches do not address this banking and leveling capacity.

This vertical system can also mitigate vertical loads which can cause or contribute to traumatic injuries or, at lower loads, cause of contribute to repetitive loading injuries with nonlinear spring systems.

These two systems are essentially independent and can be used separately or together. In some embodiments the vertical spring system supporting the footbed could be positioned on top of the horizontal system. It is preferable that these systems be integrated into a shoe sole without appreciably increasing the outer dimensions, sole thickness, or weight.

The response for reducing the likelihood of traumatic injuries should limit the loads to those required for ordinary play or tasks. For these situations the shoe could feel like an ordinary shoe for all ordinary play, maneuvers and tasks. For reducing repetitive loading injuries, and for comfort, rehabilitation, diabetics and plantar fasciitis, the responses could be at lower loads to absorb short duration shocks at low loads.

Figure 4:
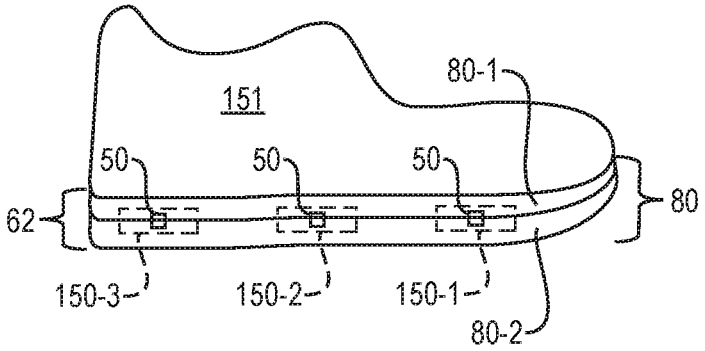
FIG. 4 is a side view of a split sole shoe system including force mitigating structures as disclosed herein.

FIG. 4 is a side view of a split sole shoe system including force mitigating structures as disclosed herein. FIG. 4 shows the sole planes 80 including one or more force mitigation structures 150-1 . . . 150-3 (150 generally) disposed for moderating the coplanar movement in a footwear article 151 (shoe). In contrast to the circumferential force mitigation beams shown in FIG. 1, a force mitigation structure 150 disposed in the sole is limited in height to avoid imposing excessive height constraints on the footwear. The force mitigation structures 150 include any suitable elastic field arrangement, structure or assembly, for example, a dimple and bump, channel spring, pincer, etc., discussed further below. It should be further noted that the definition of a "spring" refers to an object or device adapted to store and release kinetic energy according to a force and distance, and need not be a coiled or helical metal, but rather embraces the elastic field and tunable response as disclosed herein.

The footwear article 151 defines an impact absorbing footwear appliance including an upper sole 80-1 in communication with a wearer, and a lower sole 80-2 adapted for receiving forces from a ground surface in response to movement of the footwear against the ground surface. The force mitigation structures 150-N define an elastic field interface 62 between the upper sole and the lower sole, including a deformable member 50 defining the elastic field when deformed. The upper sole 80-1 and lower sole 80-2 are in a coplanar arrangement and adapted for parallel displacement, either by frictional sliding and/or via a force mitigation structure 150, where the elastic field interface 62 is disposed for transferring received forces between the upper sole and lower sole. In other words, the upper sole 80-1 bears on the lower sole 80-2, and whatever portion or regions of the sole area are not supported by a specific force mitigation structure rest on some portion of the lower sole guided by frictional engagement. While all components of movement (forward, backwards, left and right lateral, and vertical) may be addressed, the elastic field interface is deformable in response to a received force from the ground surface, in which the received force tends to dispose the upper sole and lower sole out of alignment by deformation of the elastic field interface in a plane defined by the soles 80. This would usually be characterized as a sideways component of force with a substantial component parallel to the ground surface, however elastic fields may also be deployed to counter vertical forces.

One or more deformable members 50 define an elastic field that is regulated by a cross section and resiliency of the material, rather than height. In other words, a compact deformable member 50 can achieve force mitigation via a wider, not necessarily taller, cross section, thus achieving an appropriate counterforce in a low profile suitable for mounting between the layers 80 of the split sole.

A further feature involves the return to the nondeformed position following load mitigation. This feature combines limiting the load through a combination of friction and linear return springs across the sliding interface. For example, this may combine the rubber bands attached to cleats attached to or integral to the upper and lower layers, there by spanning the slidable interface, combined with an interface designed to have a certain friction coefficient designed in, maybe with a certain roughness in the interface or especially selected materials. In many cases, a natural return of the deformed member to an undeformed state achieves this. The load would not be limited as with non-linear spring systems. Limiting the friction coefficient would limit the load ratios perpendicular and tangential to the slidable interface, which is not the same thing as limiting the load. Ideally, such a friction system would "self adjust" to the players' weight. It would be thin, making it useful for sports like gymnastics and soccer.

Figure 5:
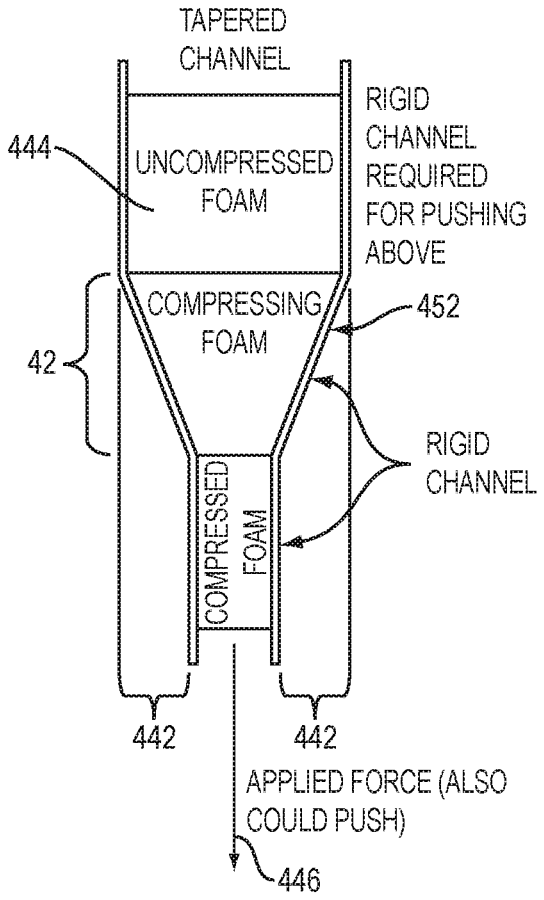
FIG. 5 shows an inclined plane approach to constant force elastic field force spring storage.
Figure 6A:
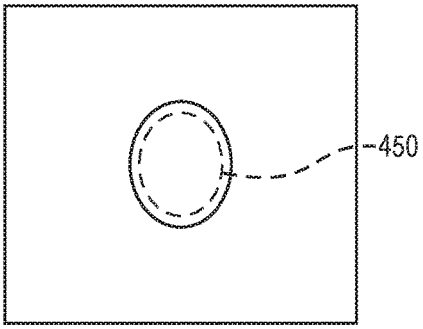
FIGS. 6A-6D show an inclined surface as in FIG. 5 in a force mitigation structure in the split sole interface of FIG. 4.
Figure 6B:
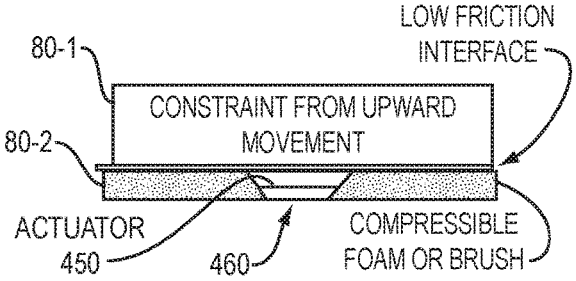
Figure 6C:
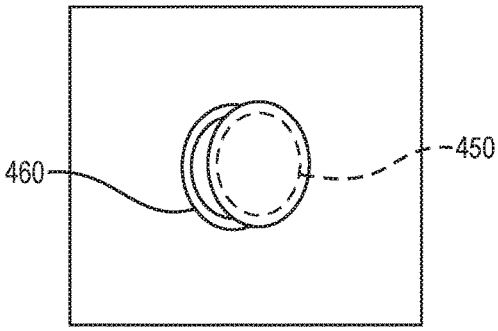
Figure 6D:
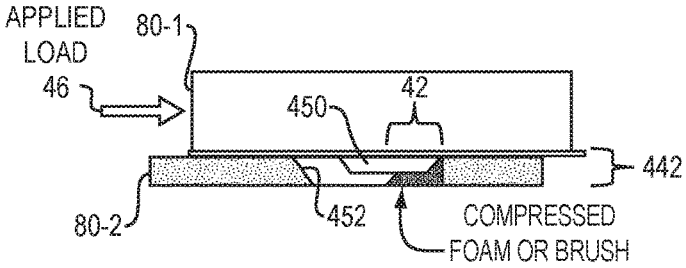

Referring to FIG. 5 an elastic field 42 is defined by a resilient and/or deformable material such as compressible foam that forms a deformation member 444. Compression or deformation of the material in the elastic field generates a constant resistance or spring-like force defined by the properties and size of the elastic field deformed with each incremental displacement. The force mitigation structure 150 further comprising a tapered region 442 defined by an inclined surface 452. The elastic field 42 includes a portion of the deformation member 444 in the tapered region 442 where the deformation member 444 undergoes compression. The tapered region 442 therefore has an area of greater cross section and an area of reduced cross section metered by the inclined surface 452. The deformation member 44 located in the tapered region 442 is adapted to be disposed from the area of greater cross section to the area of reduced cross section in response to the received force 446. By keeping the elastic field size constant, the reactive force (to the applied force 446) is also constant. Thus, as the uncompressed foam defining the deformation member 444 is pulled through a rigid channel against the inclined surface 452, a constant, or desired non-linear, reactive force results in response to the displacement, thereby absorbing energy which might otherwise contribute to injurious loads.

FIGS. 6A-6D show an inclined surface as in FIG. 5 in a force mitigation structure in the split sole interface of FIG. 4. FIGS. 6A-6D demonstrate an inclined plane approach to constant force elastic field force spring storage in the structure of FIG. 4. The upper sole 80-1 and lower sole 80-2 define opposed parallel planes, and the elastic interface is defined by an actuator attached to one of the opposed parallel planes and a deformable member attached to the other of the opposed parallel planes, such that the actuator is responsive to a transfer a received force for deforming the deformable member.

Referring to FIGS. 4-6D a solid member 450 defining an actuator resides in a circumferential recession 460 surrounded by an inclined surface 452. The solid member 450 adheres to the upper sole 80-1, and the recession 460 is in the lower sole 80-2. The tapered region 442 is defined by a cavity having at least one inclined surface 452 in slideable communication with the solid member 450 for compression in response to the received force direction 46. A slideable interface between the upper sole 80-1 and lower sole 80-2 may also be employed for complementing the elastic field interface with a frictional component.

The approach of FIGS. 6A-6D depict a relatively nondeformable protrusion surrounded by a compliant region defining an elastic field where compression occurs. An alternate dimple approach below depicts a rigid protrusion traveling in a recession while mounted in a deformable bed where compression occurs.

Versions of the dimple-cam and bump can be used in combination with other spring systems that have previously been disclosed for the shoe and might be disclosed in the future. The dimple-cam and bump system can have high initial stiffness and can then disengage providing controlled load transmission capability after the initial displacements of the bump from the center of the dimple cam.

Combination of two kinds of springs, one that is approximately linear with respect to tensile force and displacement, and a second that is stiff initially, perhaps tunable, with a high increase in load with small displacement initially, then tunable to be softer, even negative, that is, including the possibility of combining with loads decreasing with increasing displacement. The combination of the two springs would result in a response to the spring system which is initially stiff then practically constant. This system response could be initially stiff to transmit the desired control loads, then approximately constant just above ordinary control loads to absorb energy and diminish loads that could other cause traumatic injuries due to overloading. It could also be tuned to absorb small shocks that can lead to repetitive type injuries and fatigue.

Shaped dimple-cams and bumps, non-linear, nominally horizontal springs consist of two interfacing, engaging components. On one side an element with a nominally plane or regularly curved surface with a specially shaped dimple, or depression acting as a kind of cam surface. This dimple-cam interfaces with an element that includes a bump, or protrusion, on the counter face, which is similarly plane or regularly curved. The opposing surfaces on the two elements should be low in friction, like Teflon®, and relatively stiff. The bump is springy in the direction of the dimple, perpendicular to the two slidable surfaces, one with the dimple-cam and one with the bump. The bump can have a preload against the dimple. The spring can be integral to the element that contains the bump. For example, it could be a leaf spring by including two approximately parallel slots through the element, or a stiff surface layer, on either side of the bump. It could have several bridges, tethers or ligaments linking it to the rest of the component, each bridge or ligament acting like a spring on a trampoline. The bump could also be supported from behind by a spring, like a wave spring, or springy material, like a foam which could act solely or in combination with the leaf or bridge-ligament springs. These springs would respond nominally vertically, while the bump is displaced nominally horizontally against the dimple.

The nominally horizontal load-displacement relation on the dimple and bump can be tuned, or controlled, by the shape of the dimple mainly, and the bump shape as well. One embodiment could have a relatively tight-fitting pocket in the dimple that would match the curvature or shape of, at least, a portion of, the bump. The lateral load to displace this would be relatively high, providing the initial high stiffness portion of the spring. This could be tuned by the extent of the tight-fitting regions of the dimple-cam and bump on the interface. The subsequent load-displacement relations could be tuned by the curvatures, or shapes, of the dimple-cam beyond the initial pocket. The shapes could vary in different directions, providing different tuning possibilities for load-displacement relations as a function of direction. Smaller slopes would correspond to lower stiffness for nominally horizontal displacements. The steepness of the slopes in the direction of displacement of the bump in the dimple, and in the stiffness of the nominally vertical spring supporting the bump, would control the stiffness of the system. Curvature is approximately the change in slope. Curvatures of the dimple in the direction of displacement, up to the approximate curvature of the contacting portion of the bump, and the vertical stiffness changes in the spring system supporting the bump, would control the change in the stiffness during displacement.

Figure 7A:
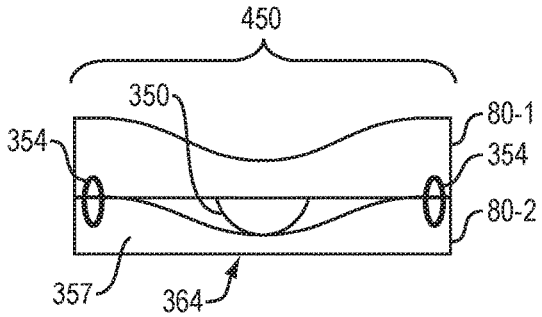
FIGS. 7A and 7B show a dimple approach to force mitigation structures in the split sole interface of FIG. 4.
Figure 7B:
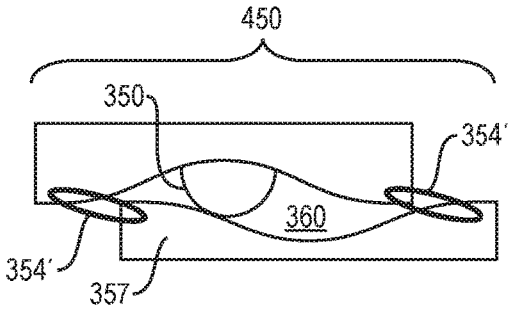

FIGS. 7A and 7B show a dimple approach to force mitigation structures in the split sole interface of FIG. 4. Referring to FIGS. 7A and 7B an elastic field for a split sole implementation absorbs forces by aligning the upper 80-1 and lower 80-2 soles. The elastic field further comprises a rigid centering element 350 mounted on a deformable bed 450 and an inclined surface 352 disposed against the centering element 350 and oriented to compress the elastic field (deformable bed 450) in response to a lateral displacement between the upper sole 80-1 and lower sole 80-2. In the example shown, the deformable member comprises the deformable bed 450 above the centering element 350 and the inclined surface 352 is defined by a recession 360 at a center. The recession 360 is a circular dimpled area having an incline around the centering element 350 engaging an inclined surface 352 in response to a received force in the direction of the plane defined by the upper and lower soles 80-1, 80-2.

The centering element 350 therefore resides in a recession 360 in a "dimpled" arrangement between the upper 80-1 and lower 80-2 sole surfaces. The inclined surface 352 serves to keep the centering element 350 in the recession 360 until disposed by lateral or forward/backward forces, and is assisted by resilient tethers 354 or bands to bias a centered arrangement. FIG. 7B shows a displaced centering element 350 slideably disposed up the inclined surface 352, while stretched tethers 354' impose tension for returning to a centered position. Variance of the recession size and the inclined plane can impart a centering bias between the upper 80-1 and lower 80-2 soles to maintain firm control to moderate forces.

The elastic field interface is therefore defined by a force mitigation structure 150 of the deformable bed 450 and dimpled centering element 350 as it moves off center and compresses as the centering element 350 disposed between the upper 80-1 and lower 80-2 sole. The deformable bed 450 is the deformable member 50 of the force mitigation structure 150.

The dimple can occupy a circular region so as to address forces in 360 degrees. In the area between the upper and lower soles 80-1, 80-2, the elastic field interface 62 may include a plurality of force mitigation structures 150, such that each force mitigation structure has an effective angle of mitigation and the plurality of force mitigation assemblies collectively cover received force emanating from 360 degrees around the upper and lower sole. In other words, some force mitigation structures may operate against forces anywhere in 360 degrees of the plane defining the soles 80. Others may address forces in a subset range, and can be aggregated such that all directions are accommodated.

In the approaches of FIGS. 6A-6D and 7A-7B, the elastic field denotes an equilibrium position defined by alignment of the upper sole 80-1 and lower sole 80-2. The elastic field is a spring that is loaded perpendicular to the interface, when the layers, 80-1 and 80-2 are displaced relative to each other. During alignment or "centering" of the actuator/protrusion, the elastic field is not deformed beyond an intended preload, if used, and not storing energy due to nominally horizontal relative displacements across the slidable interface between the layers. Once acted upon by a received force, the deformable member defining the elastic field is responsive to the received force by deformation. The elastic field is adapted to convert and to store kinetic energy converted to elastic in response to the deformation. This elastic energy will be used for returning to the equilibrium position when the loading incident is over.

Figure 8:
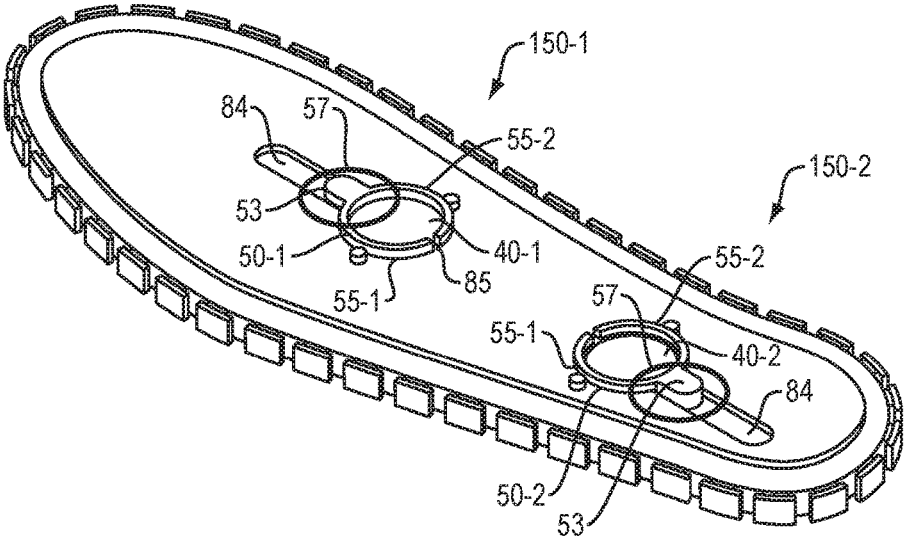
FIG. 8 shows an alternate force mitigation structure using a pincer element.

FIG. 8 shows an alternative arrangement of a pincher system including a force mitigation structure directed to multiple components of movement. FIG. 8 depicts a deformable member in the shape of a "pincer." A pincer may be defined as blunt concave jaws or extensions that are arranged like a thumb and forefinger of approximately equal lengths, used for gripping and pulling.

In the configuration of FIG. 8, the deformable members defined define flanking annular members 55 wrap around or pinch relatively rigid, center posts 40. A plurality of elastic flanking arms 55 extends around the rigid posts 40. The elastic arms may be restrained by pins or other rigid stop at 90 and 270 degrees around the rigid post. At 0 degrees the pins are attached to a sliding central post 53 (slider) with hinges that allow them to move in towards the rigid post under little or no load, outward movement of the pincers requires elastic deformation of the annular members 55 of the pincers. Responding to received forces and the flanking arms slideably engaging an annular surface of an actuator for deformation responsive to the received force. In the configuration shown in FIG. 8, an opposed pair of pincher systems and corresponding center posts 53 are employed, such that the flanking arms each extend toward the opposed actuator for absorbing coplanar movement in 360 degrees, discussed further below.

The force mitigation structure 150 includes a deformable member 50 in the shape of a pincer having a sliding central post 53 and the flanking members are defined by opposed annular members 55-1 . . . 55-2 extending along a common plane therefrom, defined by the upper sole 80-1 and lower sole 80-2. In addition, the bottom sole 80-2 includes one or more relief slots 84 with a longitudinal dimension substantially parallel to the annular members 55. A rigid member 40-1 . . . 40-2 defines an actuator and extends perpendicular to the common plane and is disposed between the annular members 55-1 . . . 55-2 (55 generally), as if being "pinched" by the pincer.

Continuing to refer to FIG. 8, the sliding central post 53 couples to one of the wearer interface or the sole surface, and the rigid member 40-1 couples to the other of the wearer interface or the sole surface. In other words, the central post 53 and rigid members 40 attach to the opposed upper and lower soles 80-1 . . . 80-2 as disposed by the received force. A base 57 engages the central post 53 in a relief slot 84. The slot 84 moves with the central post 40 except in a direction defined by the rigid member 40 in the direction through the center of the rigid member 40, when the central post 53 is blocked by interference with the rigid member 40, when movement is accommodated by the relief slots 84. To accommodate, in the configuration of FIG. 9, another force mitigation structure 150-2 is defined by an opposed cylindrical rigid member 40-2. The opposed cylindrical rigid member 40-2 is engaged by a pincer having a central post 53 and gap 85 in a reversed orientation, thus in the case of movement "blocking" the central post, the opposed rigid member 40 and pincer oppose the force via movement afforded from the relief slot 84.

The annular members 55 are adapted to slideably deform around the rigid member 40 in response to the received force. As shown, the rigid member 40 is cylindrical and the annular members 55 are substantially semicircular for simultaneously engaging a circumference of the rigid member 40. The annular members 55 define an arc around the circumference and terminate at a gap or slot 85 opposed from the central post 53 from which the annular members 55 extend.

The force mitigation structures 150-1 . . . 150-2 of FIG. 8 absorb forces from a wider range of directions. In general, left and right lateral forces, and either forward or backward forces will resiliently deform the deformable member 150. Forces that dispose the central post 53 against the rigid member 40 can be mitigated by an opposed deformable member 150-2. This configuration includes an opposed cylindrical rigid member 40-2, such that the opposed cylindrical rigid member 40-2 is engaged by a pincer having a central post and gap or slot 84 in a reversed orientation. 360 degree force mitigation can therefore be achieved.

In the example of FIGS. 8 and 9A-9F, the force mitigation structure 150 further includes a pincer having a central post 53 and opposed annular members 55 extending along a common plane therefrom, and a rigid member 40 extending perpendicular to the common plane and disposed between the annular members. The annular members flank and extend circularly or substantially circular around the rigid member 40 (actuator), which reacts to a received force. The central post 53 couples to one of the wearer interface or the sole surface, and the rigid member 40 couples to the other of the wearer interface or the sole surface. Thus the opposed annular members 55 are adapted to slideably deform around the rigid member 40 in response to the received force as the central post 53 and rigid member 40 are drawn apart and the annular members 55 need deform to allow travel of the central post 53 relative to the rigid member 40.

In the example arrangement, the rigid member 40 is cylindrical and the annular members 55 are substantially semicircular for simultaneously engaging a circumference of the rigid member 40. Therefore, the annular members 55 define an arc around the circumference and terminate at a gap 85 opposed from the central post 53 from which the annular members 55 extend.

Figure 9D:
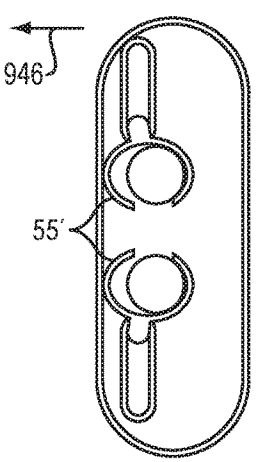
FIGS. 9A-9F show a pincer implementation to force mitigation structures in the split sole interface of FIG. 4.
Figure 9C:
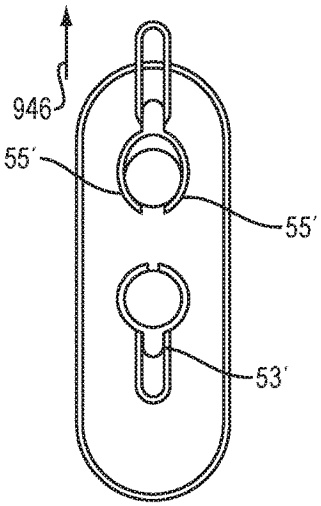
Figure 9B:
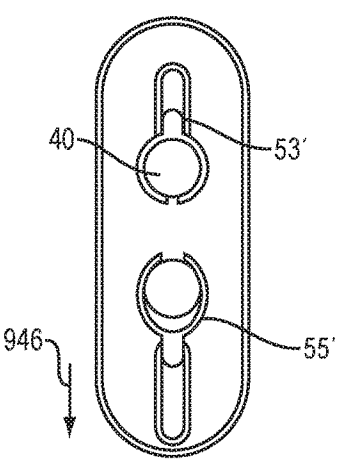
Figure 9A:
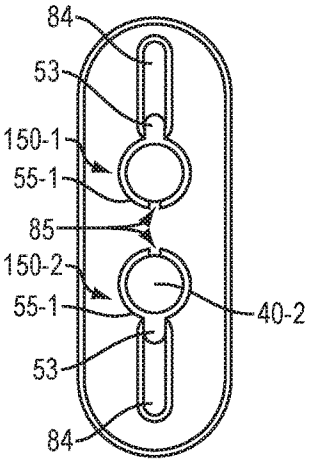

FIGS. 9A-9E show reactions of the force mitigation structures of FIG. 8 in the split sole interface of FIG. 4. Referring to FIGS. 8 and 9A-9E, the opposed pair of pincers address 360 degrees of forces tending to displace the upper and lower soles 80-1, 80-2 through a combination of deformation of the annular members 55. FIG. 9A shows a rest or equilibrium position. The force mitigation structures 150-1 . . . 150-2 define an opposed pair of force mitigation structures, each having annular members 55 extending in a substantially opposed direction to the annular members 55 of the opposed force mitigation structure 150. In other words, the "opening" of the pincer structures face the other opening of the opposed pincer, as each surrounds a respective rigid member 40.

Referring to FIGS. 9B and 9C, in response to a forward or rearward component of force 946, annular members 55 of one of the opposed pair of force mitigation structures deform slideably outward along the rigid member 40. Deformed annular members 55' expand to accommodate travel from the rigid member, while the center post 53' of the opposed pincer disposes in slot 84 since it cannot advance, being fully engaged with the rigid member 40.

Figure 9F:
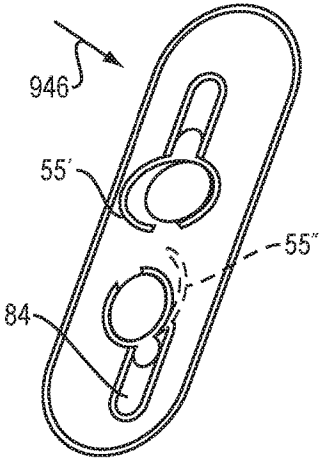
Figure 9E:
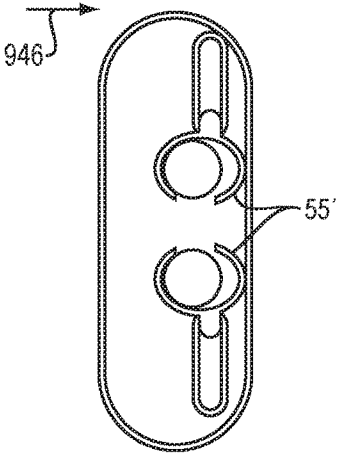

FIGS. 9D and 9E show deflection from a lateral (left or right) force in response to a component of a received force in a lateral direction 946, the annular members 55' on corresponding sides of the opposed pair deform outward against the rigid member 40. FIG. 9F shows, in response to a received force in a rotary direction or diagonal direction, an annular member 55' of one of the opposed pair deforms outward against the rigid member 40, and the annular member on the opposed side of the other annular member may deform 55" (dotted line) outward against the rigid member or may remain undeformed, depending on a direction and axis of the force 946.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. An impact absorbing footwear apparatus, comprising:
an upper sole in communication with a wearer;
a lower sole adapted for receiving forces from a ground surface in response to movement of the footwear against the ground surface; and
an elastic field interface between the upper sole and the lower sole, the upper sole and lower sole in coplanar arrangement and adapted for parallel displacement, the elastic field interface including an actuator attached to one of the upper sole and lower sole and disposed for transferring received forces between the upper sole and lower sole.

2. The apparatus of claim 1 wherein the elastic field interface is deformable in response to a received force from the ground surface, the received force tending to dispose the upper sole and lower sole out of alignment by deformation of the elastic field interface.

3. The apparatus of claim 2 further comprising an equilibrium position defined by alignment of the upper sole and lower sole, the elastic field having a deformable member responsive to a received force by deformation, the elastic field adapted to store kinetic energy in response to the deformation for returning to the equilibrium position.

4. The apparatus of claim 1 wherein the upper sole and lower sole define opposed parallel planes, the elastic field interface including a deformable member attached to the other of the opposed parallel planes, the actuator responsive to a transfer a received force for deforming the deformable member.

5. The apparatus of claim 1 wherein the elastic field further comprises a deformable bed having an attached protrusion and an inclined surface disposed against theft protrusion and oriented to compress the elastic field in response to a lateral displacement between the upper sole and lower sole.

6. The apparatus of claim 5 wherein the deformable bed opposes the recession and the protrusion extends towards the recession.

7. The apparatus of claim 6 wherein the recession is a circular dimpled area having an incline around the deformable member, the deformable member engaging the inclined surface in response to a received force in the direction of the plane defined by the upper and lower soles.

8. The apparatus of claim 4 further comprising a slideable interface between upper sole and lower sole, the slideable interface complementing the elastic field interface with a frictional component.

9. The apparatus of claim 1 wherein the elastic field interface is defined by a force mitigation structure disposed between the upper and lower sole, the force mitigation structure including a deformable member defining the elastic field and a solid actuator adapted to deform the deformable member response to the received force.

10. A method for mitigating harmful forces between a footwear sole and a ground surface, comprising:

receiving, at a lower sole adapted for receiving forces from a ground surface in response to movement of the footwear against the ground surface, a disposing force;

deforming, in response to the disposing force, an elastic field interface between an upper sole in communication with a wearer and the lower sole, the upper sole and lower sole in coplanar arrangement and adapted for parallel displacement, the elastic field interface including an actuator attached to one of the upper sole and lower sole and disposed for transferring received forces between the upper sole and lower sole.

11. An impact absorbing footwear apparatus, comprising:

an upper sole in communication with a wearer;

a lower sole adapted for receiving forces from a ground surface in response to movement of the footwear against the ground surface; and an elastic field interface between the upper sole and the lower sole, the upper sole and lower sole in coplanar arrangement and adapted for parallel displacement, the elastic field interface disposed for transferring received forces between the upper sole and lower sole, the elastic field further comprising a deformable bed having an attached protrusion, and an inclined surface disposed against the protrusion and oriented to compress the elastic field in response to a lateral displacement between the upper sole and lower sole.

* * * * *